US007823360B1

(12) United States Patent
Cottle

(10) Patent No.: US 7,823,360 B1
(45) Date of Patent: Nov. 2, 2010

(54) OPEN CORE BUILDING BLOCKS SYSTEM

(76) Inventor: Jared Cottle, 7409 S. First St., Broken Arrow, OK (US) 74001

( * ) Notice: Subject to any disclaimer, the term of this patent is extended or adjusted under 35 U.S.C. 154(b) by 0 days.

(21) Appl. No.: 11/807,093

(22) Filed: May 24, 2007

Related U.S. Application Data

(60) Provisional application No. 60/808,302, filed on May 24, 2006.

(51) Int. Cl.
*E04B 5/04* (2006.01)
*E04C 2/04* (2006.01)

(52) U.S. Cl. ..... 52/608; 52/604; 52/606; 52/607

(58) Field of Classification Search ..... 52/604, 52/606, 607, 608, 503, 505, 245, 429
See application file for complete search history.

(56) References Cited

U.S. PATENT DOCUMENTS

| | | | |
|---|---|---|---|
| 228,052 | A | 5/1880 | Frost |
| 468,838 | A | 2/1892 | Steiger |
| 474,285 | A | 5/1892 | Borgner |
| 566,924 | A | 9/1896 | Morrin |
| 811,534 | A | 2/1906 | Akers |
| 829,711 | A | 8/1906 | Gaylor |
| 847,476 | A | 3/1907 | Hodges |
| 916,687 | A | 3/1909 | Everett |
| 916,756 | A | 3/1909 | Mosstman |
| 1,002,161 | A | 8/1911 | Lambert |
| 1,092,621 | A | 4/1914 | Worner |
| 1,219,127 | A | 3/1917 | Marshall |
| 1,287,055 | A | 12/1918 | Lehman |
| 1,330,884 | A | 2/1920 | McDermott |
| 1,388,181 | A | 8/1921 | Guimonneau |
| 1,456,498 | A | 5/1923 | Binns |
| 1,468,892 | A | 9/1923 | Mehr |
| 1,516,473 | A | 11/1924 | Davis |
| 1,727,363 | A | 9/1929 | Bone |
| 2,141,397 | A | 12/1938 | Locke |
| 2,157,992 | A | 5/1939 | Smith |
| 3,036,407 | A | 5/1962 | Dixon |
| 3,557,505 | A | 1/1971 | Kaul |
| 3,936,987 | A | 2/1976 | Calvin |
| 3,995,434 | A | 12/1976 | Kato |
| 4,001,988 | A | 1/1977 | Riefler |
| 4,098,040 | A | 7/1978 | Riefler |
| 4,107,894 | A | 8/1978 | Mullins |
| 4,123,881 | A | 11/1978 | Muse |
| 4,148,166 | A | 4/1979 | Toone |
| 4,175,888 | A | 11/1979 | Ijima |
| 4,186,540 | A | 2/1980 | Mullins |
| 4,190,384 | A | 2/1980 | Neumann |
| 4,262,463 | A | 4/1981 | Hapel |
| 4,301,637 | A | 11/1981 | Anderson |
| 4,312,606 | A | 1/1982 | Sarikelle |

(Continued)

*Primary Examiner*—Richard E Chilcot, Jr.
*Assistant Examiner*—Andrew J Triggs
(74) *Attorney, Agent, or Firm*—Crowe & Dunlevy

(57) ABSTRACT

A system for utilizing building blocks to build a corrugated structural section that incorporates continuous longitudinal reinforcement with an offset joint pattern. The system includes building blocks whose shapes include open-core units. The use of the system results in a corrugated structural section that is useful for construction of walls, screens, fences, floors, roofs, and other construction elements requiring corrugated structural panels.

4 Claims, 24 Drawing Sheets

U.S. PATENT DOCUMENTS

| | | | | | |
|---|---|---|---|---|---|
| 4,372,091 | A | | 2/1983 | Brown | |
| 4,380,409 | A | | 4/1983 | O'Neill | |
| 4,640,071 | A | | 2/1987 | Haener | |
| 4,651,485 | A | | 3/1987 | Osborne | |
| D296,365 | S | | 6/1988 | Forsberg | |
| D297,464 | S | | 8/1988 | Forsberg | |
| D297,574 | S | | 9/1988 | Forsberg | |
| D297,767 | S | | 9/1988 | Forsberg | |
| D298,463 | S | | 11/1988 | Forsberg | |
| 4,802,320 | A | * | 2/1989 | Forsberg | 52/585.1 |
| D300,253 | S | | 3/1989 | Forsberg | |
| D300,254 | S | | 3/1989 | Forsberg | |
| D301,064 | S | | 5/1989 | Forsberg | |
| 4,825,619 | A | * | 5/1989 | Forsberg | 405/286 |
| 4,896,999 | A | | 1/1990 | Ruckstuhl | |
| D316,904 | S | | 5/1991 | Forsberg | |
| D317,048 | S | | 5/1991 | Forsberg | |
| D317,209 | S | | 5/1991 | Forsberg | |
| 5,044,834 | A | | 9/1991 | Janopaul, Jr. | |
| 5,400,563 | A | | 3/1995 | House | |
| 5,490,363 | A | * | 2/1996 | Woolford | 52/604 |
| 5,551,198 | A | | 9/1996 | Schaaf | |
| 5,588,786 | A | | 12/1996 | House | |
| 5,623,797 | A | | 4/1997 | Gravier | |
| 5,653,558 | A | | 8/1997 | Price | |
| 5,685,119 | A | | 11/1997 | Zschoppe | |
| 5,704,183 | A | * | 1/1998 | Woolford | 52/604 |
| 5,709,062 | A | * | 1/1998 | Woolford | 52/604 |
| 5,711,129 | A | * | 1/1998 | Woolford | 52/604 |
| 5,729,943 | A | | 3/1998 | Cambiuzzi | |
| D397,230 | S | | 8/1998 | Forsberg | |
| 5,788,423 | A | | 8/1998 | Perkins | |
| 5,795,105 | A | * | 8/1998 | Guth | 405/284 |
| 5,894,702 | A | | 4/1999 | Stenekes | |
| 5,951,210 | A | * | 9/1999 | Maguire et al. | 405/286 |
| D417,506 | S | | 12/1999 | Harding | |
| 6,035,599 | A | | 3/2000 | Sonnentag | |
| 6,113,318 | A | * | 9/2000 | Guth | 405/284 |
| 6,168,353 | B1 | * | 1/2001 | Price | 405/284 |
| 6,205,735 | B1 | * | 3/2001 | Witcher | 52/604 |
| RE37,278 | E | * | 7/2001 | Forsberg | 52/585.1 |
| 6,253,519 | B1 | | 7/2001 | Daniel | |
| 6,490,837 | B1 | | 12/2002 | Dueck | |
| 6,508,041 | B1 | * | 1/2003 | Boot | 52/578 |
| 6,539,684 | B1 | * | 4/2003 | Graham | 52/609 |
| 6,641,334 | B2 | * | 11/2003 | Woolford | 405/284 |
| 7,185,470 | B1 | * | 3/2007 | Link | 52/605 |
| 7,384,215 | B2 | * | 6/2008 | Woolford | 405/284 |
| 2002/0187010 | A1 | * | 12/2002 | MacDonald et al. | 405/284 |
| 2003/0012609 | A1 | * | 1/2003 | Woolford | 405/284 |
| 2004/0028484 | A1 | * | 2/2004 | Woolford | 405/286 |

* cited by examiner

OPEN CORE BUILDING BLOCKS SYSTEM

RELATED APPLICATIONS

The present application claims the benefit of U.S. Provisional Patent Application No. 60/808,302, filed May 24, 2006, entitled Open Core Building Blocks System, the disclosure of which is hereby incorporated by reference.

FIELD OF THE INVENTION

This invention generally relates to building block systems, and more specifically to building blocks with open-core units useful for construction of walls, screens, fences, floors, roofs, and other construction elements requiring structural panels.

BACKGROUND

Current building block design and construction practices generally adhere to a closed-core/closed cavity model. This mode of construction has been dutifully adopted without regard to material efficiency or to the widely known shortfalls of continuous panel walls in building construction.

Inherent to continuous panel walls constructed with continuous flange building blocks is material inefficiency. Classic block construction consists of the familiar, rectangular, concrete masonry units CMU with two closed cores that are readily available at construction supply wholesalers and retailers. The blocks are mortared and leveled by masonry crews who reinforce the walls by placing grout with embedded reinforcing bars, rods, or cables within one or both of the two cores. Strength design calculations for these units are based on the compressive strength capacity of the wall section—the concrete face subject to loading, and on the tensile strength of the reinforcing rods, bars, or cables. Other than the area of the block face subject to loading, the compression face, generally less than the total thickness of the face, and the tension reinforcing; no other components factor into the strength design calculations. Thus, neither the parallel face opposite the loading source i.e. side opposite the wind direction nor the interior cores figure into the strength design. Thus, an entire side of structurally superfluous material is created by following the typical closed core, closed cavity block system.

In contrast, corrugated panels have long been recognized and used as a means for optimizing panel materials and strength. Easily recognized examples include cardboard boxes and corrugated sheet metal used for roof decking, floor decking, wall siding, and drainage pipes. Formed and cast-in-place concrete construction including tilt-up concrete walls for industrial and commercial buildings operations have approached this optimization by utilizing the T-beam shapes seen on highway bridges and parking garage floor decks as well as the industrial and commercial buildings previously mentioned. The structural optimization derived in these widely known applications has not been successfully transferred to building block construction. A quick site visit to almost any new construction project in any area of the country reveals that in spite of the multitude of patented block designs, the shape of choice remains the standard, rectangular, concrete masonry unit CMU with two cores.

SUMMARY OF THE INVENTION

In accordance with the present invention, a single open-core building block includes an exterior face connected to a pair of flange assemblies and at least one reinforcing strut.

Each of the flange assemblies includes an intermittent flange and a web strut, which connects the intermittent flange to the exterior face. The reinforcing strut is connected to each of the flange assemblies, and can also connect to the exterior face of the building block. The present invention further provides for a double open-core building block, largely the same as the single-core building block that may include the same elements found in the single open-core building block with the addition of an closed-core assembly attached centrally to the exterior face of the double open-core building block. In another aspect, the present invention also provides a method for utilizing open-core building blocks to construct a corrugated structural wall that includes continuous longitudinal cores suitable for reinforcement by a variety of reinforcing materials.

WRITTEN DESCRIPTION

Figure 1:
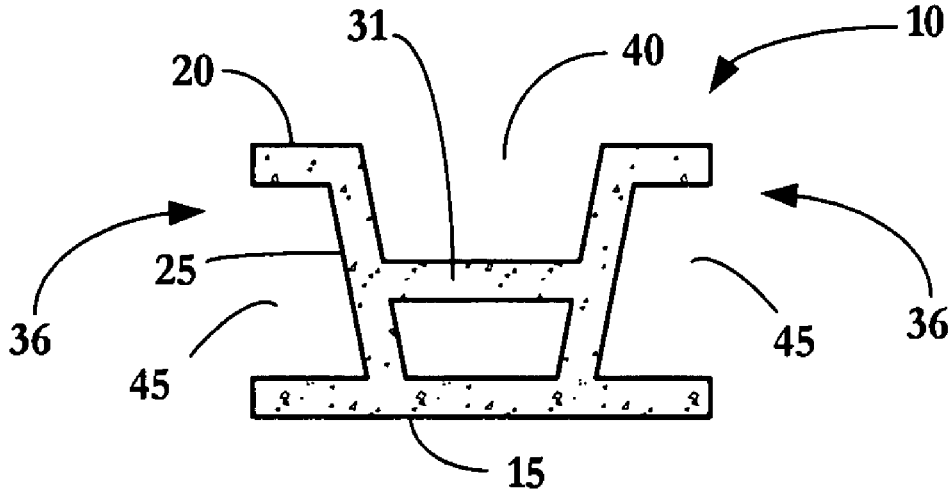
FIG. 1 is a top view of a single open-core block unit constructed in accordance with a preferred embodiment.
Figure 2:
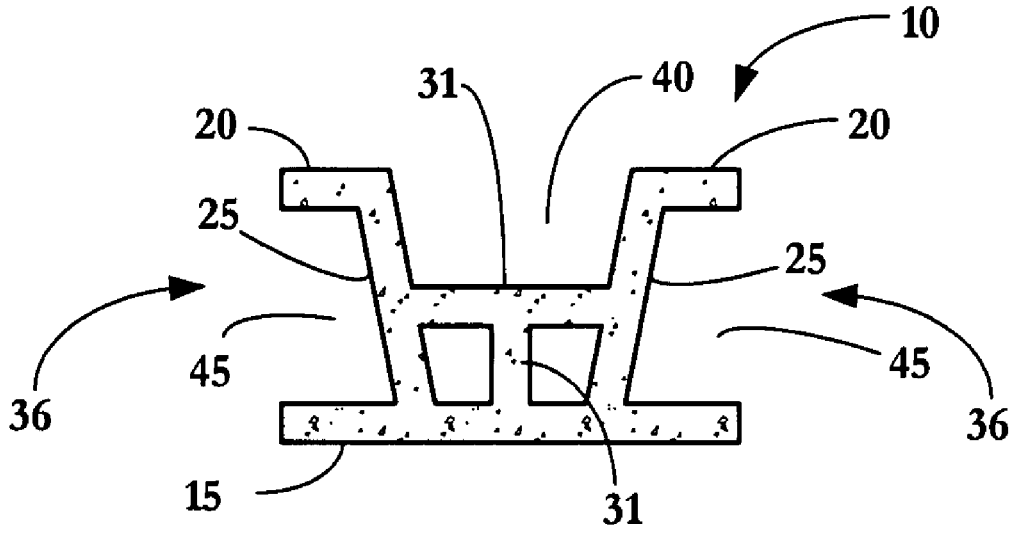
FIG. 2 is a top view of an alternate embodiment of the single open-core block of FIG. 1 with bisected lateral web bracing.
Figure 3:
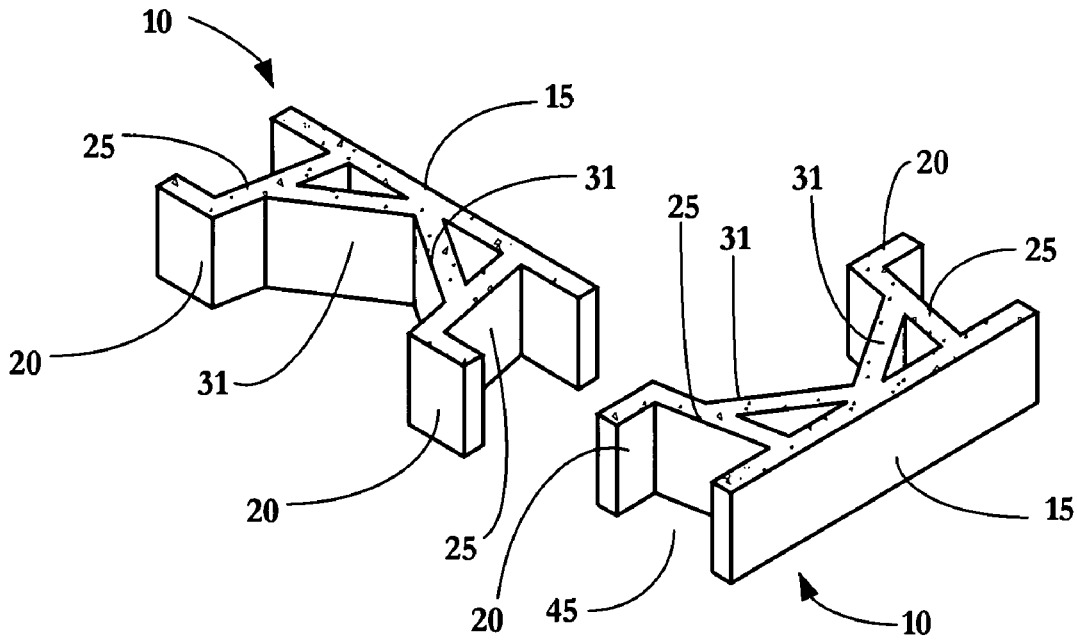
FIG. 3 shows perspective views of a single open-core block unit.
Figure 4:
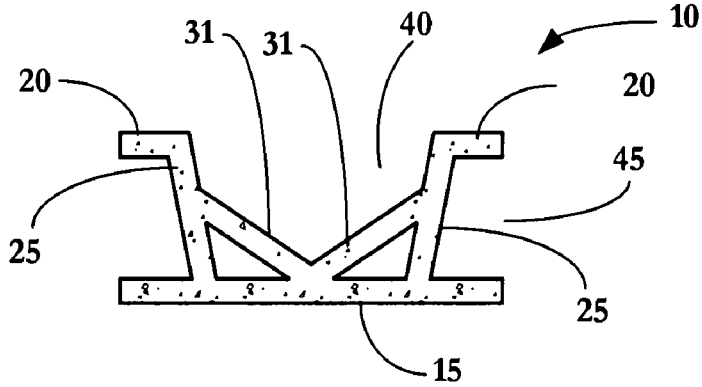
FIG. 4 is a top view of the single open-core block unit of FIG. 3.
Figure 5:
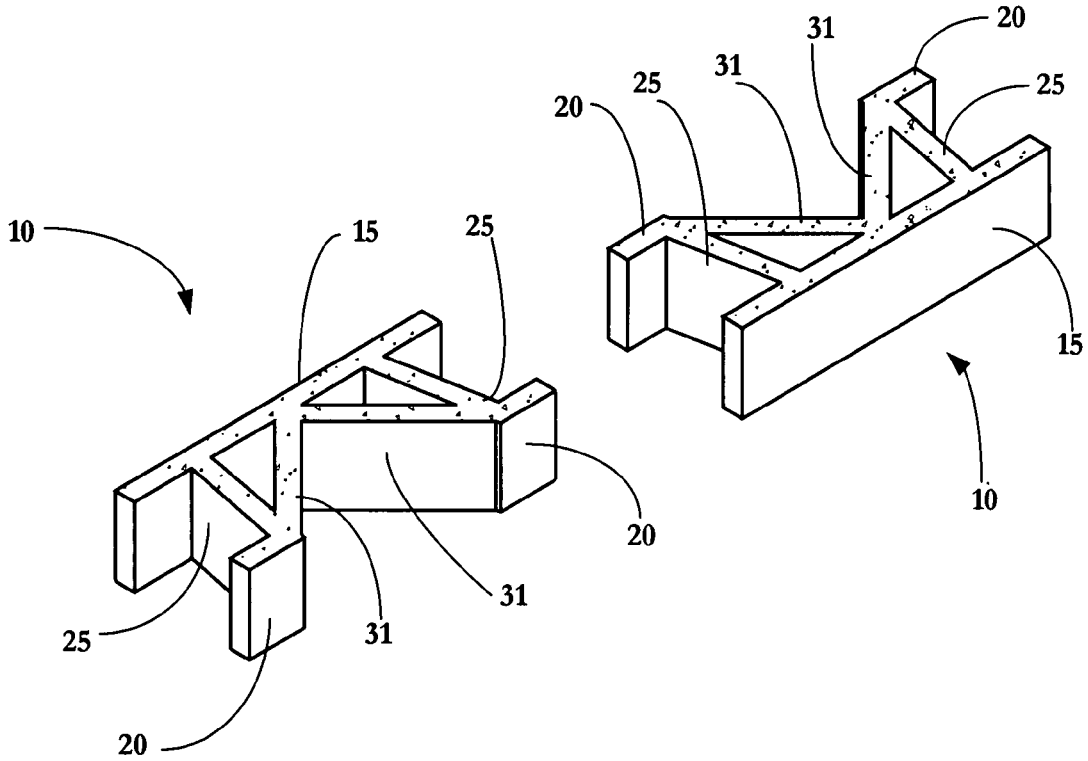
FIG. 5 shows perspective views of an alternate embodiment of the single open-core block unit of FIG. 3.
Figure 6:
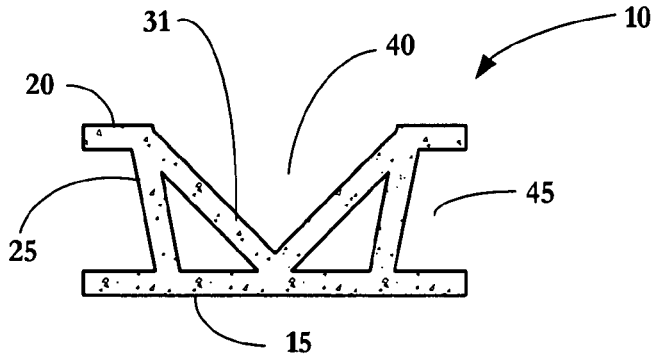
FIG. 6 is a top view of the alternate embodiment of the single open-core block unit of FIG. 5.

Referring to FIG. 1, shown therein is a preferred embodiment of a single-open core block unit 10. The single open-core block unit 10 preferably includes a primary face 15, a pair of connecting flanges 20, a pair of web struts 25 and a reinforcing strut 31. Each web strut 25 is connected between a respective connecting flange 20 and the primary face 15. Each web strut 25 and its respective connecting flange 20 collectively form a connecting flange assembly 36. In the embodiment shown in FIG. 1, the reinforcing strut 31 is connected to the web struts 25 and extends in a plane substantially parallel to the plane that contain the primary face 15. The reinforcement strut 31 reduces the unsupported span of the primary face 15, thereby enhancing the overall structural performance of the wall section.

Figure 32:
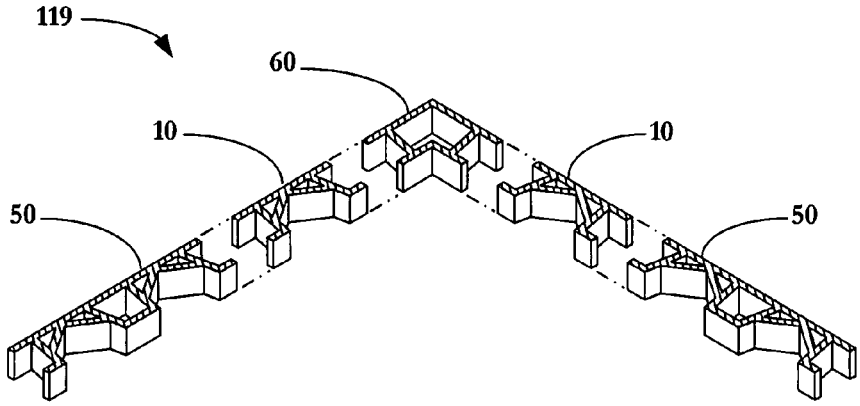
FIG. 32 is an exploded perspective view of an alignment for a single row of the blocks from FIGS. 3, 7, and 13.
Figure 33:
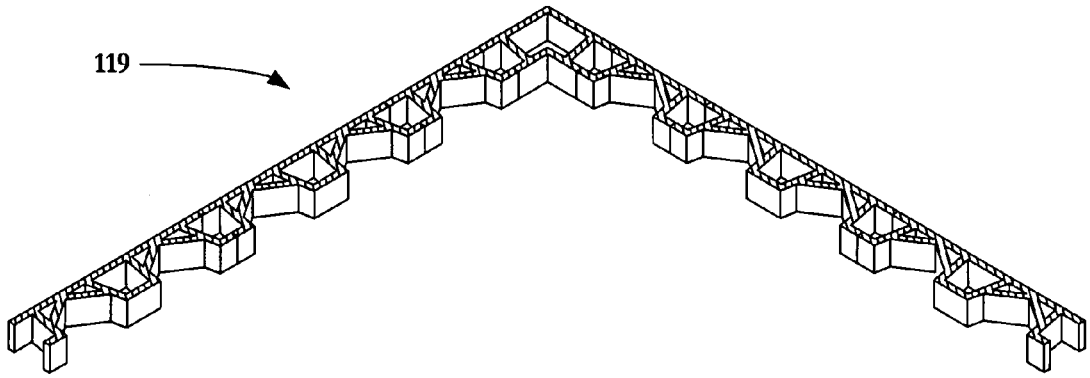
FIG. 33 is a perspective view of an aligned single row of the blocks from FIGS. 3, 7, and 13.
Figure 34:
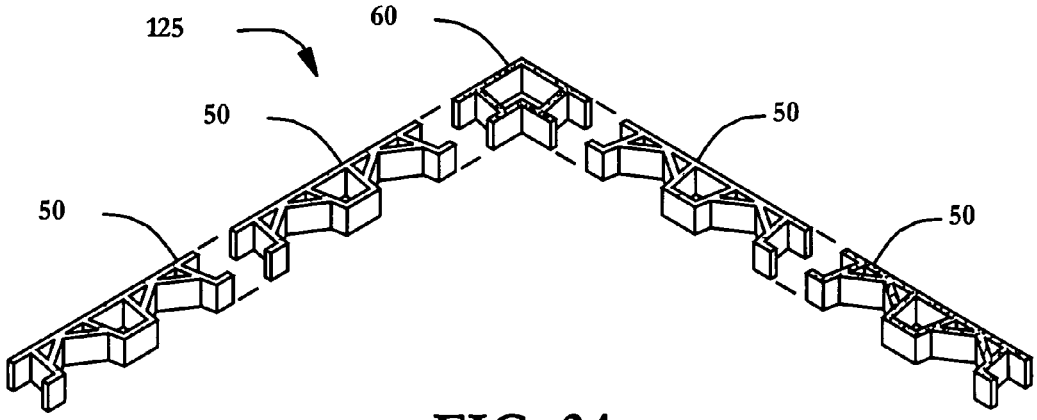
FIG. 34 is an exploded perspective view of an alignment for a second row of the blocks from FIGS. 3, 7, and 13.

An open cavity 40 is defined as the unenclosed recess bounded by the reinforcing strut 31 and the web struts 25 and accessible from a direction generally perpendicular to the primary face 15. In construction applications, the open cavity 40 can be used to route electrical wiring, plumbing or other service conduits. Open cores 45 are defined as the space between the primary face 15, each of the connecting flanges 20 and each of the web struts 25. The open cores 45 become enclosed upon juxtaposition with other building block units of the present invention and provide a housing for installation of continuous longitudinal reinforcement. Open cores 45 can be used to route structural supports and concrete during construction. A structural wall section 119, as shown in FIGS. 32 and 33, can be formed by butting the primary face 15 and connecting flanges 20 of adjacent single open-core block units 10, or other building block units of the present invention, to form a corrugated pattern of alternating cores 45 and cavities 40.

Figure 7:
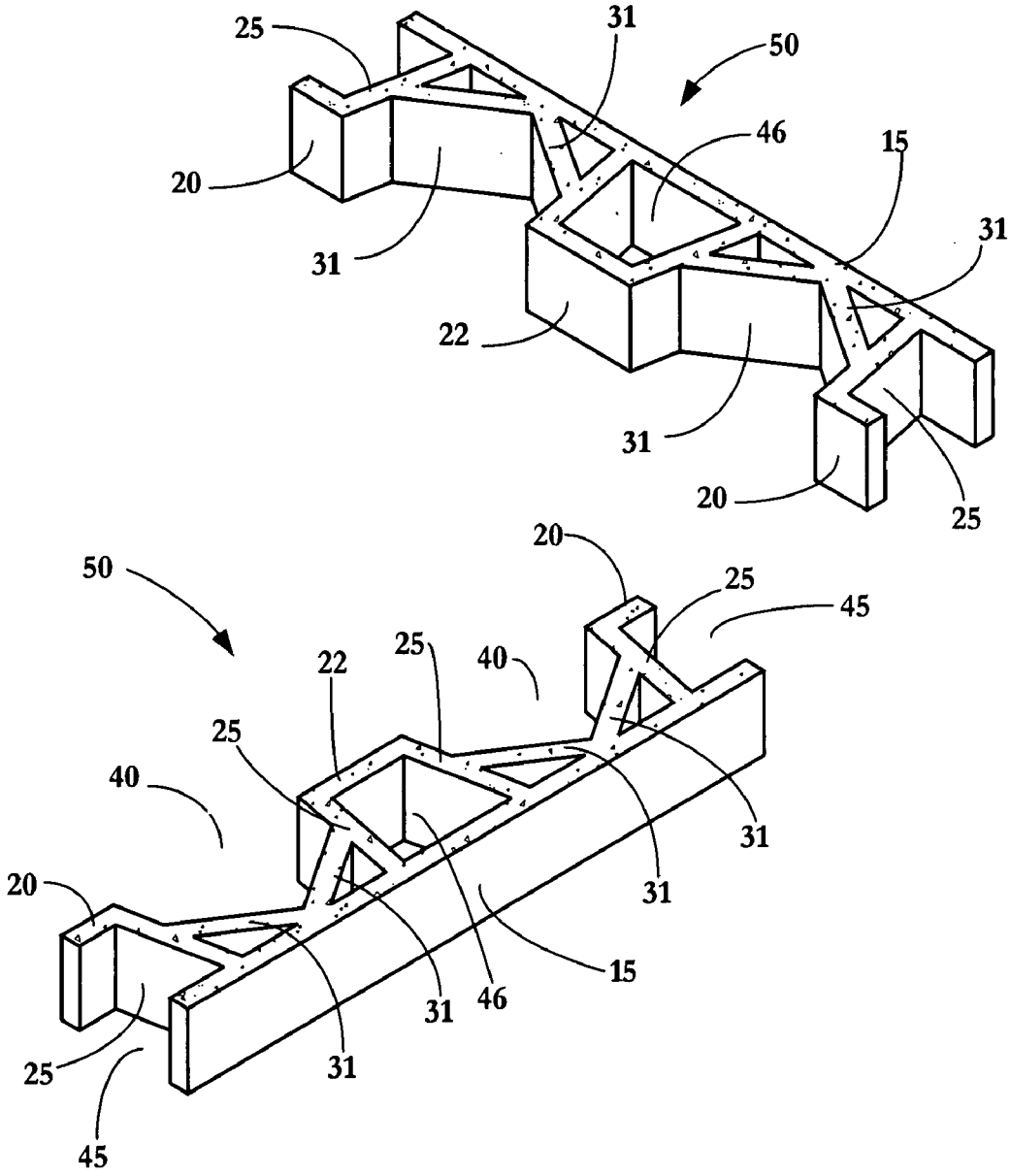
FIG. 7 shows a perspective views of a double open-core block unit.
Figure 8:
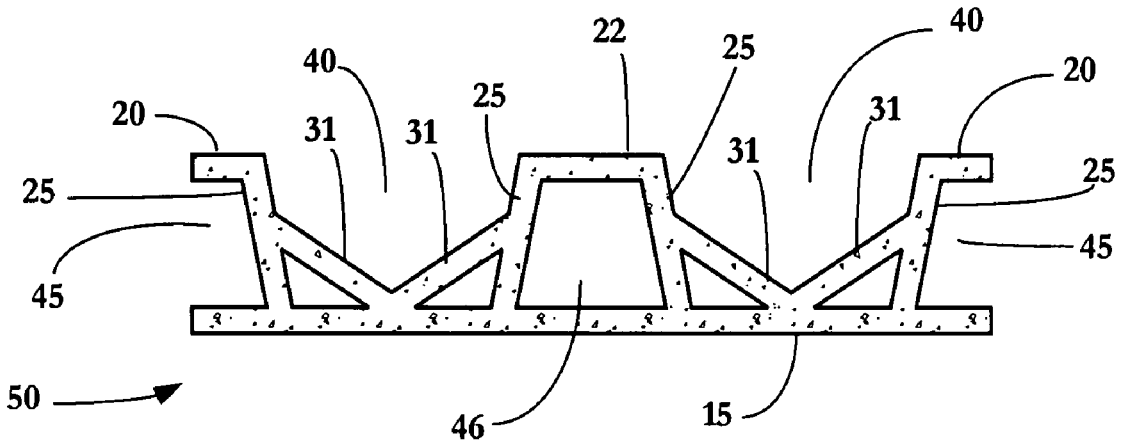
FIG. 8 is a top view of the double open-core block unit of FIG. 7.
Figure 9:
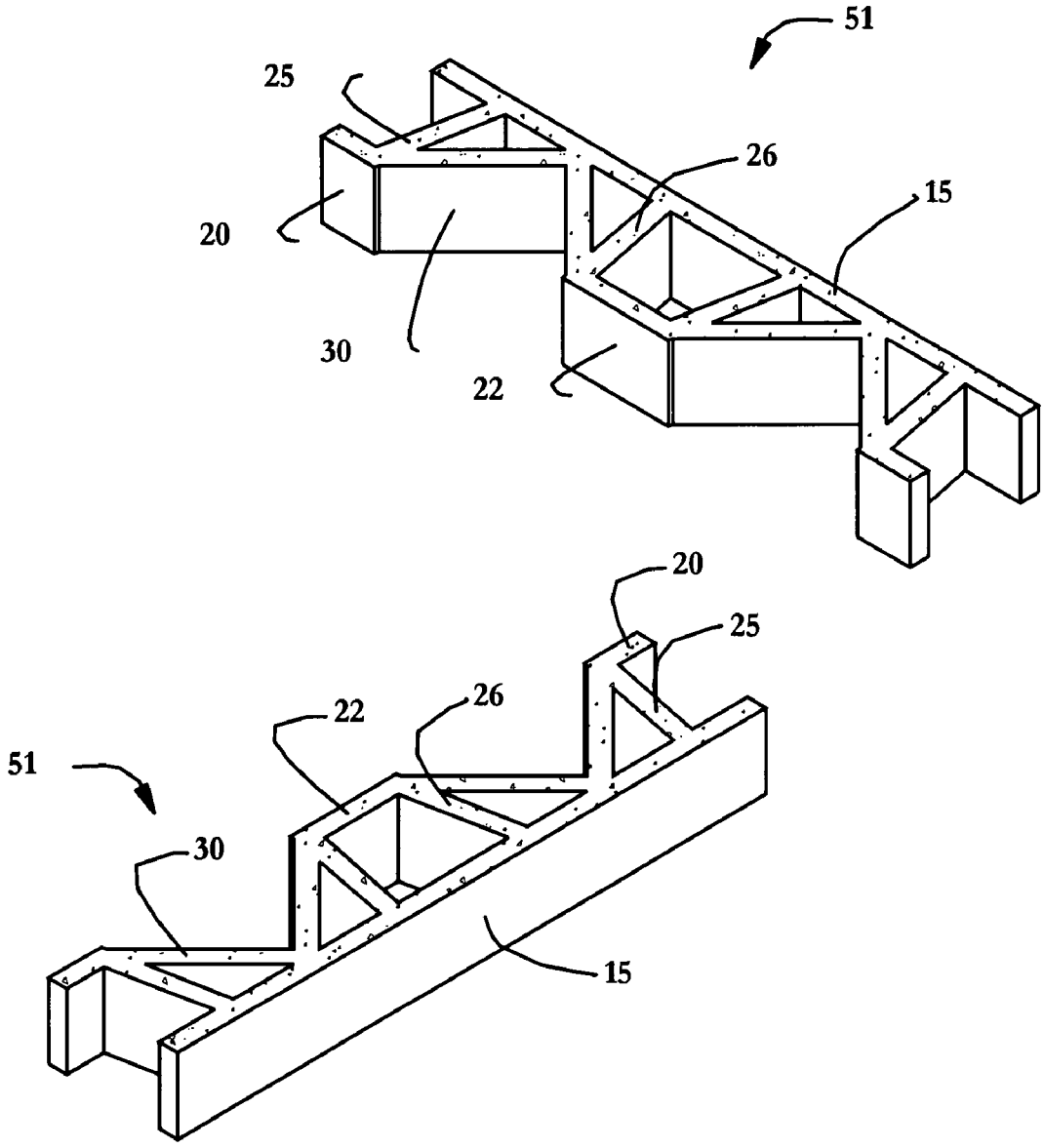
FIG. 9 shows perspective views of an alternate embodiment of the double open-core block unit of FIG. 7.
Figure 10:
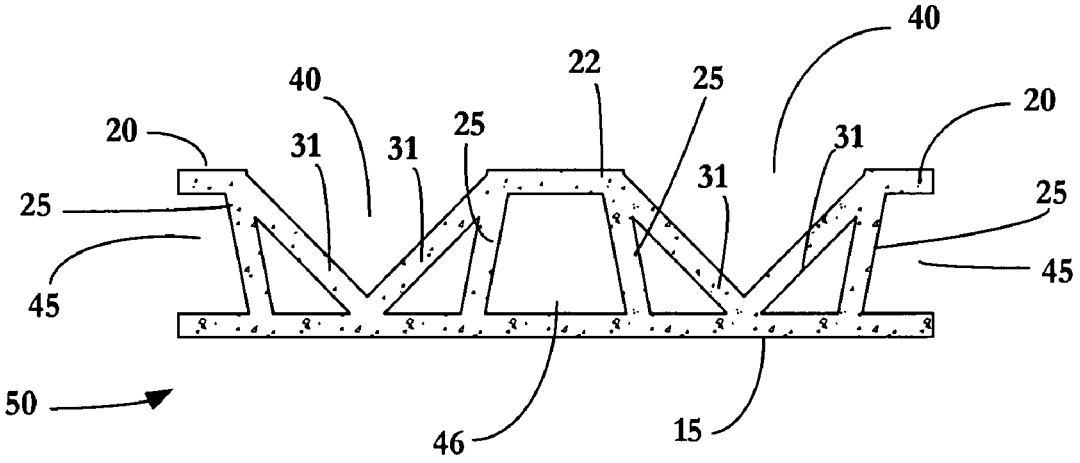
FIG. 10 is a top view of the alternate embodiment of the double open-core block unit of FIG. 7.
Figure 11:
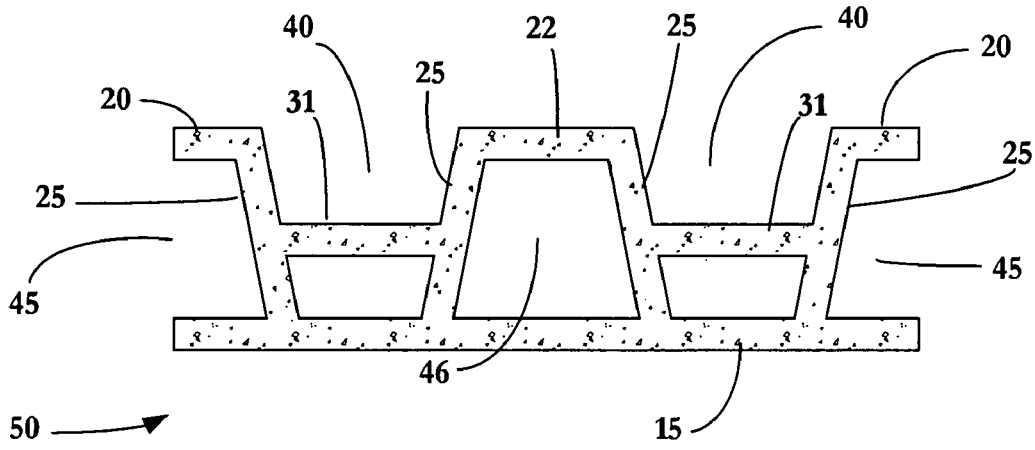
FIG. 11 is a top view of an alternate embodiment double open-core block unit of FIG. 7 with lateral web bracing in lieu of diagonal web bracing.
Figure 12:
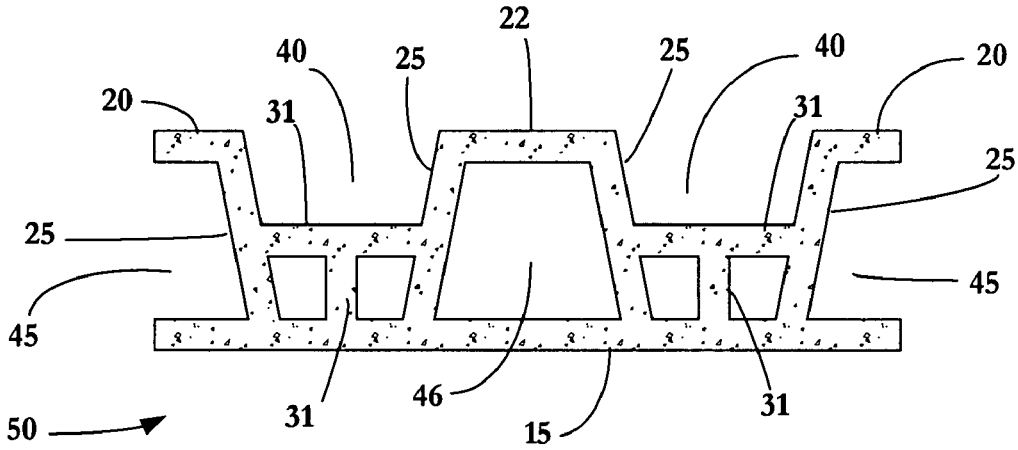
FIG. 12 is a top view of an alternate embodiment double open-core block unit of FIG. 7 with bisected lateral web bracing.

Longer spans and off-set vertical joints may be obtained by incorporating the double open-core block units 50 depicted in FIGS. 7 and 8. In the preferred embodiment, a double open-core block unit 50 is comprised of a primary face 15, a pair of connecting flanges 20, a plurality of web struts 25, a plurality of reinforcing struts 31, and an intermittent flange 22. A closed core 46 is disposed between the interior web struts 25, the primary face 15 and the intermittent flange 22. Because of the repetition of the unit geometry between the single open-core block unit 10 and the double open-core block unit 50, the corrugated pattern of alternating cores 45 and cavities 40 is maintained with the addition of a closed core 46 formed by two interior web struts 25 and a single intermittent flange 22 in the sequence.

Figure 13:
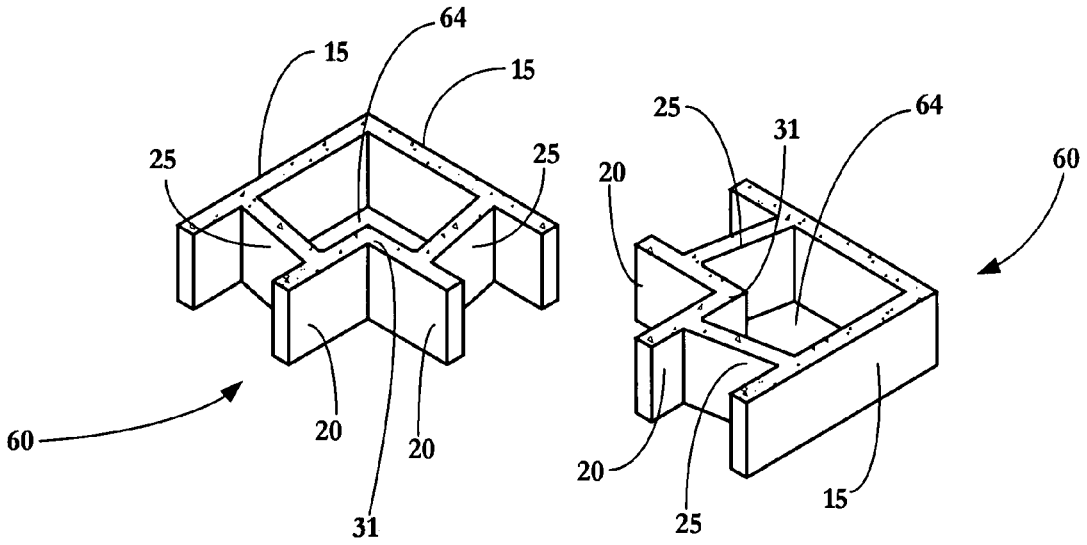
FIG. 13 shows perspective views of a corner block unit.
Figure 14:
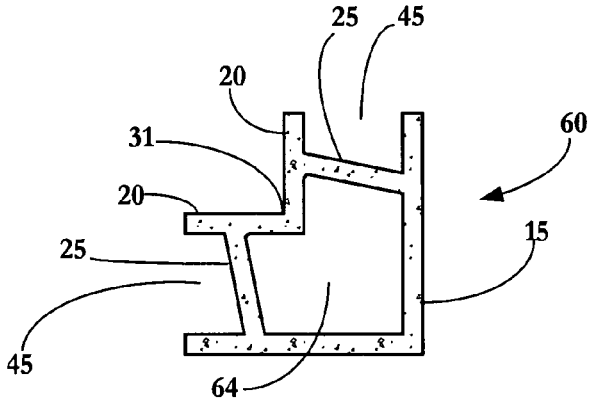
FIG. 14 is a top view of the corner block unit of FIG. 13.

Directional changes in the block alignment may be accomplished by inserting a corner block unit 60 as shown in FIG. 13 and FIG. 14 into the sequence described above. The corner block unit 60 is identical to the single open-core block unit 10 with the only change being that the primary face 15 of the corner block unit 60 is bent to form a corner in the primary face 15. As shown in FIG. 32 and FIG. 33, the primary face 16 of the corner block units 60 are butted directly against the primary face 15 and connecting flanges 20 flanges of either the single open-core block units 10 or double open-core block units 50. The connection of the corner block unit 60 to the adjacent single open-core block unit 10 or double open-core block unit 50 forms two flanking cores 45 and a single closed-core 64 to contain the vertical reinforcement means.

Figure 30:
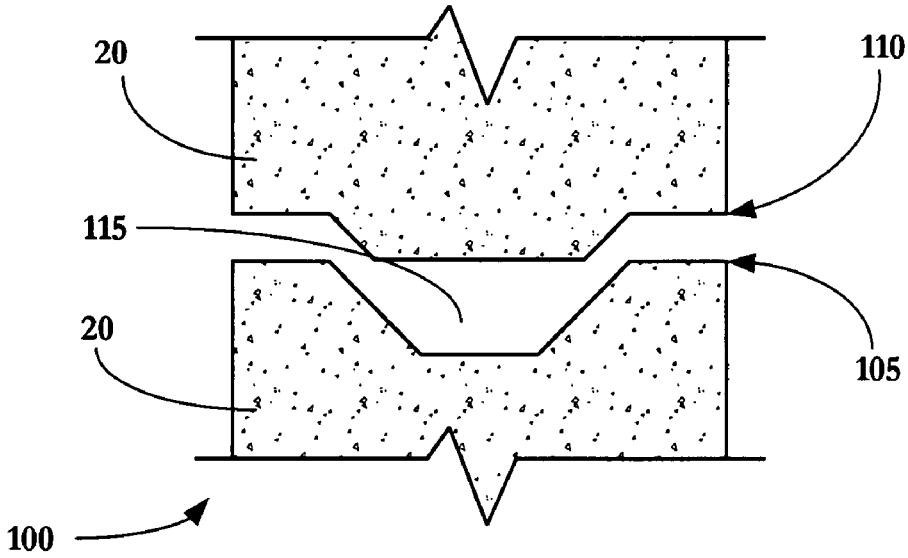
FIG. 30 is an end view of a tongue-and-groove joint aligned prior to engagement.
Figure 31:
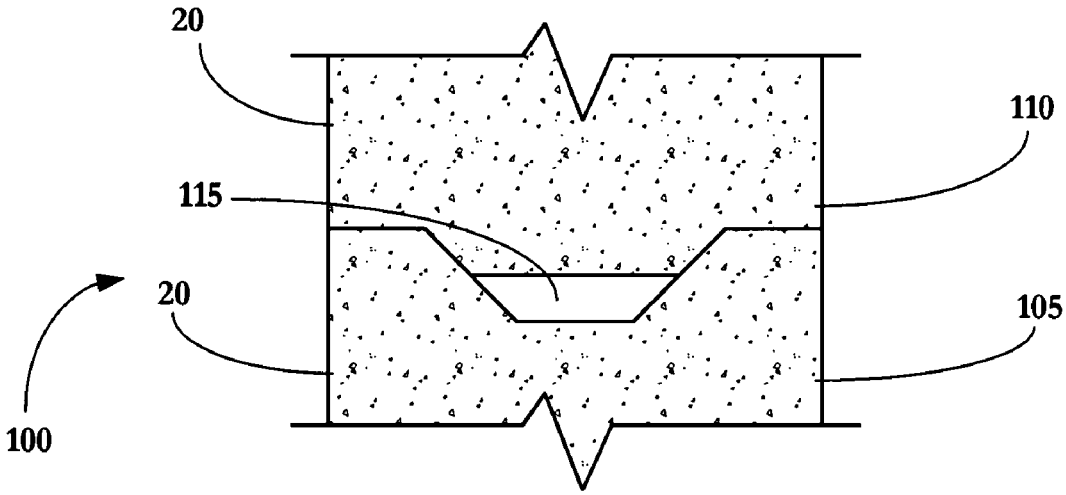
FIG. 31 is an end view of the tongue-and-groove joint of FIG. 30 after engagement.

Turning now to FIGS. 30 and 31, therein depicted is a preferable feature common to all blocks of the present invention, specifically interfacing joints 100 located on a top side 105 and a bottom side 110 of the connecting flanges 20 and web struts 25 of the blocks of the present invention. While FIGS. 30 and 31 depict a standard tongue and groove joint, any joint comprised of protrusions or recesses can be utilized. The example interfacing joint 100 depicted in FIGS. 30 and 31 provides a pre-formed channel 115 to be filled with a bonding agent or sealant to prevent moisture penetration. The example tongue-and-groove joint also has the advantage of providing alignment control for the installation of successive rows of blocks.

Figure 35:
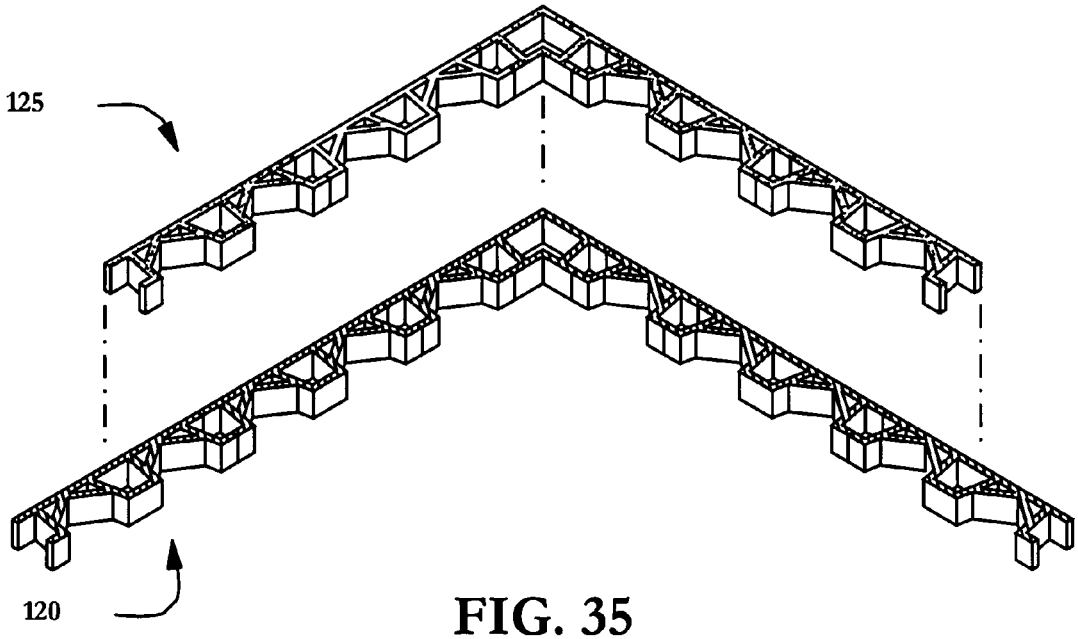
FIG. 35 is an exploded perspective view of the aligned rows of blocks from FIGS. 33 and 34.
Figure 36:
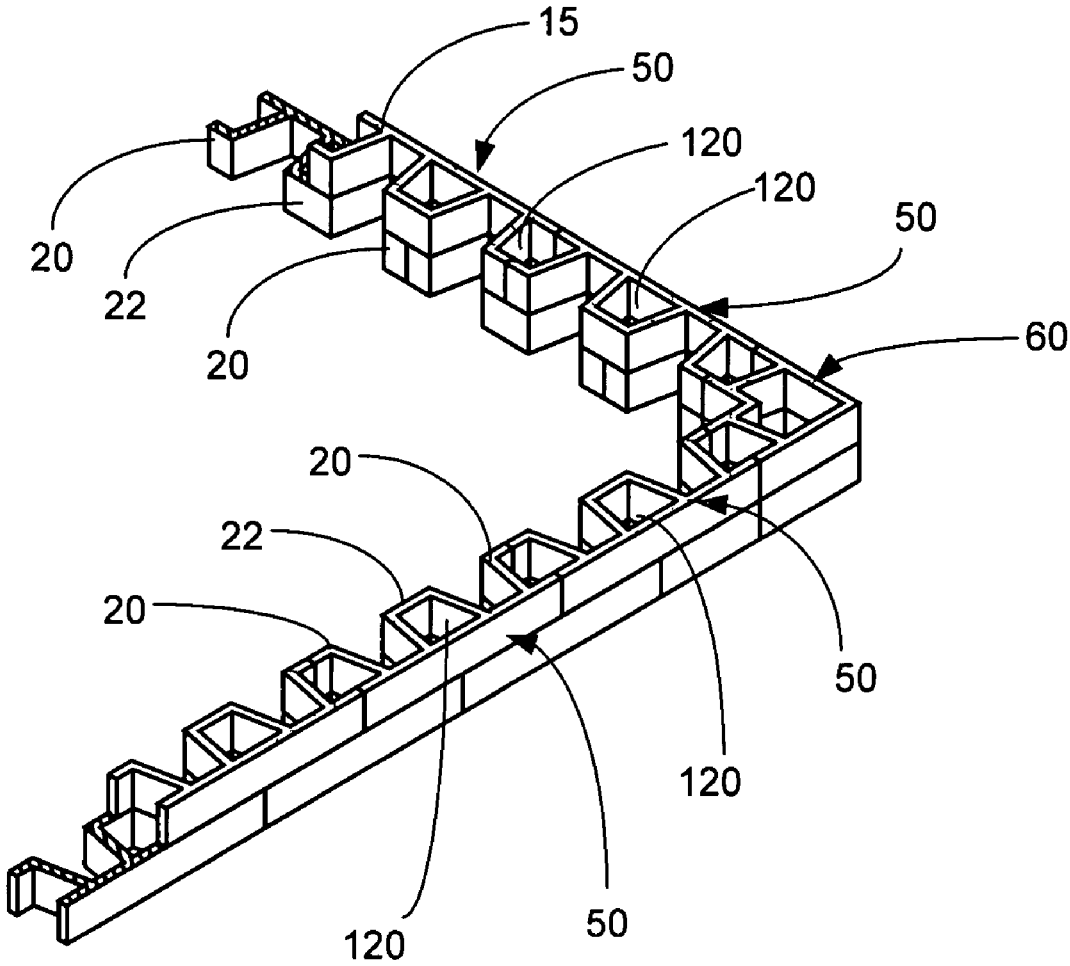
FIG. 36 is a perspective view of the aligned rows of blocks from FIG. 35.

Construction of a typical wall section is outlined in FIGS. 35 and 36, which depict rows of blocks being stacked so that continuous vertical cores 120 are formed that will house the longitudinal reinforcement of the structural panel. The alternative overlapping use of single open-core block units 10 and double open-core block units 50 creates an off-set vertical joint pattern as shown in FIG. 36.

Figure 39:
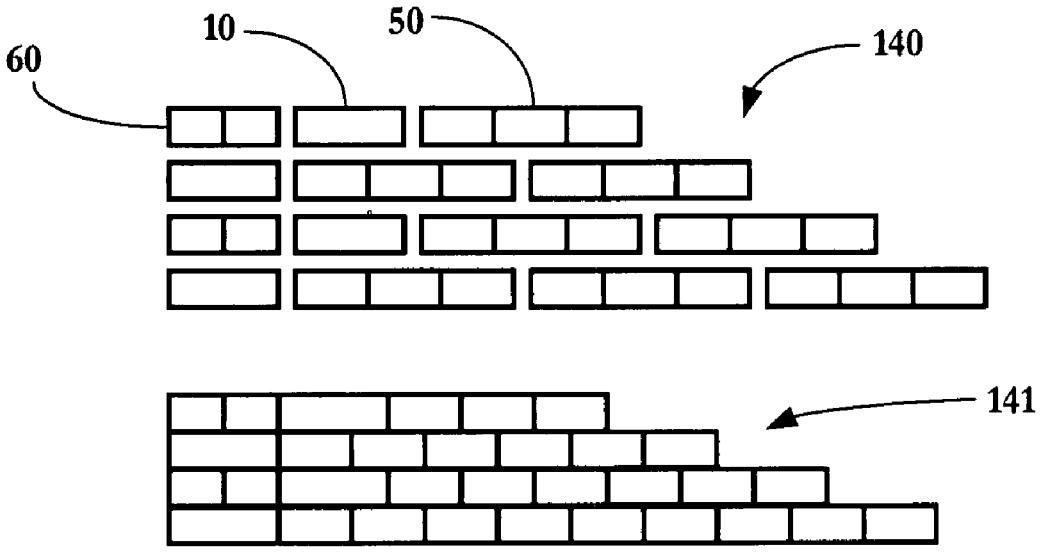
FIG. 39 shows front views of the blocks from FIGS. 3, 7, and 13, imprinted with a brick pattern, aligned and stacked for installation.
Figure 41:
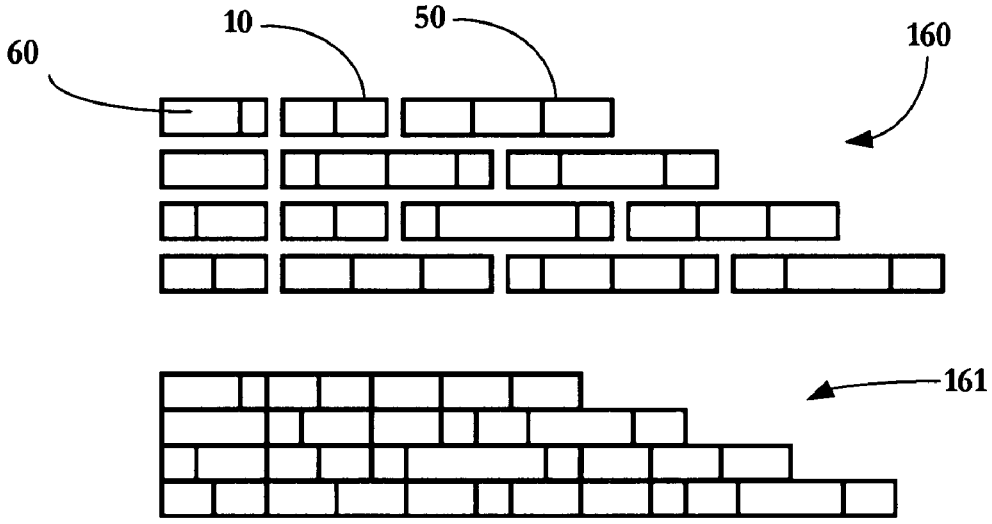
FIG. 41 shows front views of the blocks from FIGS. 3, 7, and 13, imprinted with a stone pattern, aligned and stacked for installation.

With a natural, off-set joint pattern, imprinting and coloring the blocks to mimic brick or stone construction provides a means to complete the structure and external finish in a single operation. Blocks may be fabricated from almost any material including industry standard concrete block materials and coloring admixtures to produce the desired appearance. Typical brick patterns 140 for use with corner block units 60, single open-core block units 10, and double open-core block units 50 are exhibited in FIG. 39. Once assembled, the typical brick pattern 140 provides an alternating corner pattern with a running bond pattern 141 for the rest of the wall construction. Typical stone patterns 160 for corner block units 60, single open-core block units 10, and double open-core block units 70 are exhibited in FIG. 41. Once assembled, the typical stone pattern 160 provides an alternating corner pattern with a random stone pattern 161 for the rest of the wall construction.

As shown in FIG. 36, block units may be joined by standard masonry construction methods using mortared joints or the rows may be stacked without mortar and the longitudinal reinforcing installed in the continuous vertical cores 120, provided the reinforcing system creates a positive mechanical connection between blocks and rows. If mortar is not used, a joint such as a tongue-and-groove joint 100 between the succeeding rows should be filled with a sealant to prevent moisture penetration. In either case, all continuous vertical cores 120 should be provided with continuous longitudinal reinforcing as required to achieve the desired structural capacity. Because of the shape of the blocks, the resulting assembly may be analyzed as a series of T-beams.

Figure 37:
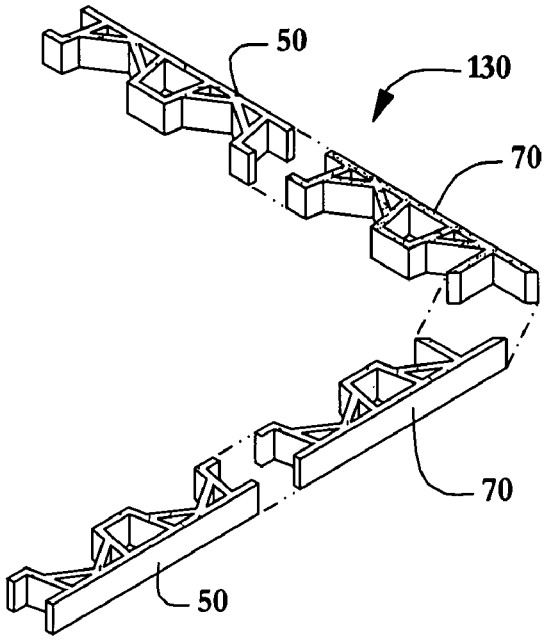
FIG. 37 is an exploded perspective view of an alignment for a single row of the blocks from FIGS. 7 and 17.
Figure 38:
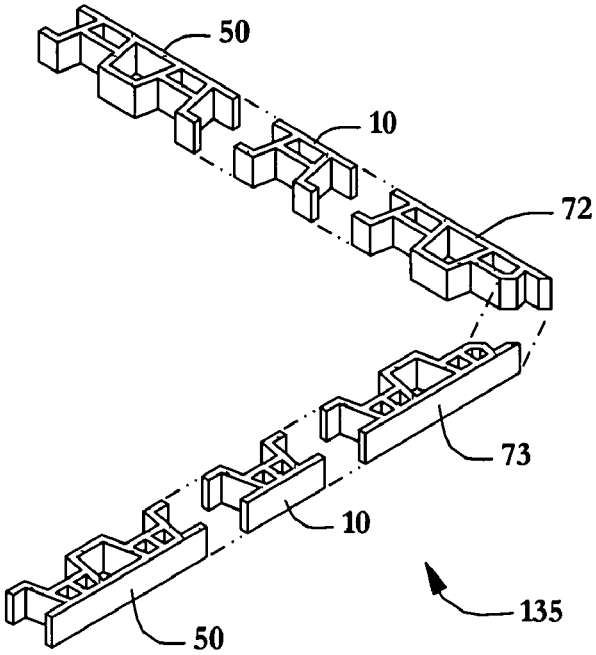
FIG. 38 is an exploded perspective view of an alignment for a single row of the blocks from FIGS. 1, 2, 11, 12, 21, and 22.

Several alternative embodiments of the present invention may also be derived, primarily through utilizing modified shapes for the basic block types previously described. For example, several such alternative embodiments are depicted in FIGS. 2, 3, 4, 5, and 6. Any of these alternative single open-core block unit 10 designs may be substituted in place of the single open-core block unit 10 shown in FIG. 1. Transferring the same concept from the single block design to alternative embodiments for the double open-core block units 50, FIGS. 9, 10, 11, and 12 illustrate the additional designs. Substitutions of these alternative units into a block sequence are shown in FIGS. 37 and 38.

Figure 15:
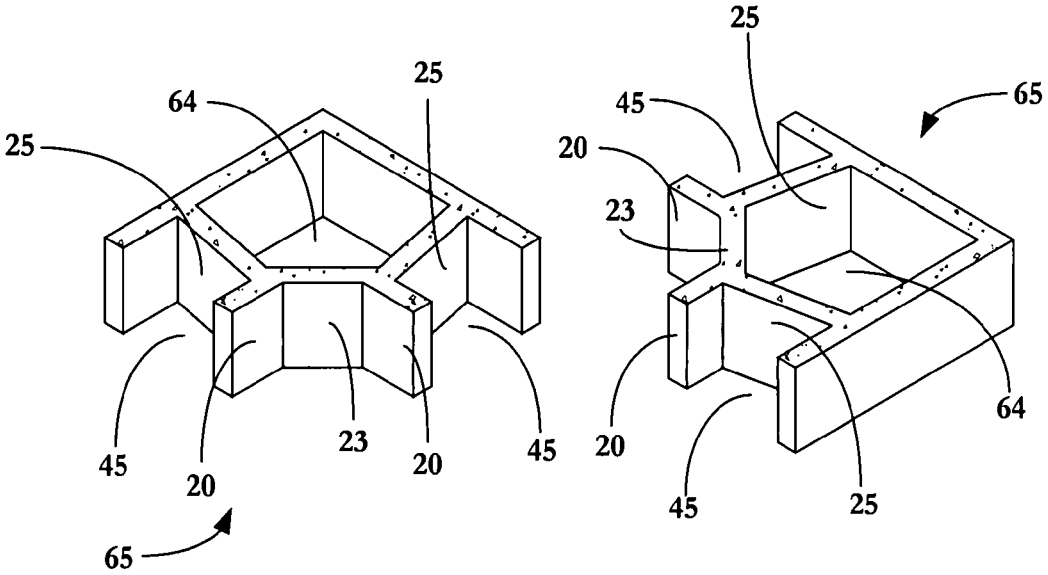
FIG. 15 shows a perspective views of an alternate corner block unit.
Figure 16:
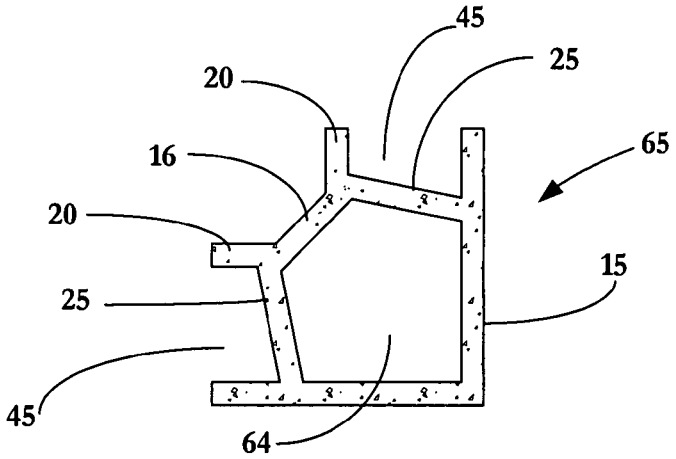
FIG. 16 is a top view of the alternate corner block unit of FIG. 16.

Wall corners may also be constructed with alternative embodiments to those discussed above. FIGS. 15 and 16 show a corner block unit 65 comprised of a single closed-core 64 flanked by two open-cores 45. The difference between this corner unit 65 and the corner block unit 60 shown in FIG. 13 is the use of a trapezoidal reinforcing strut 16.

Figure 17:
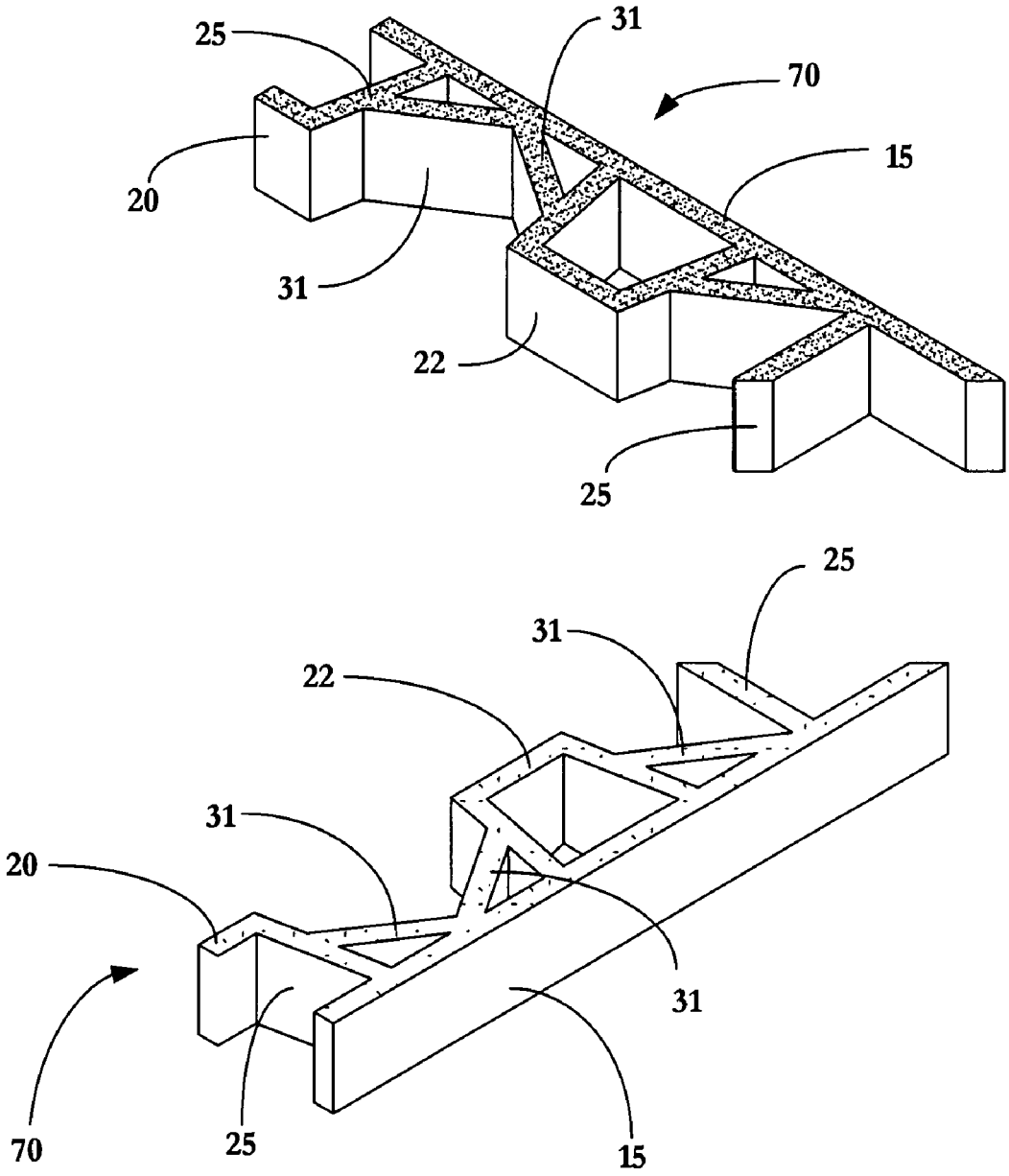
FIG. 17 shows perspective views of an alternate corner block unit derived by chamfering the double open-core block of FIG. 7.
Figure 18:
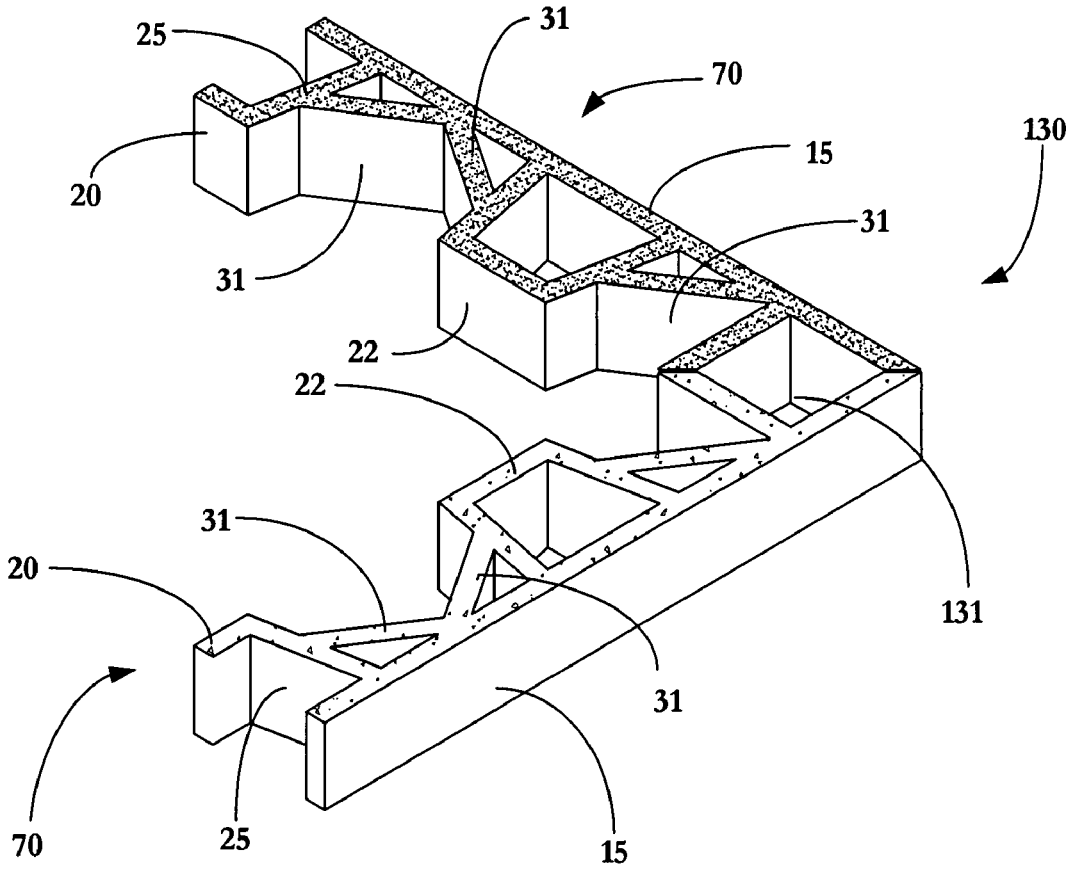
FIG. 18 is a top view of the alternate corner block unit of FIG. 16.
Figure 19:
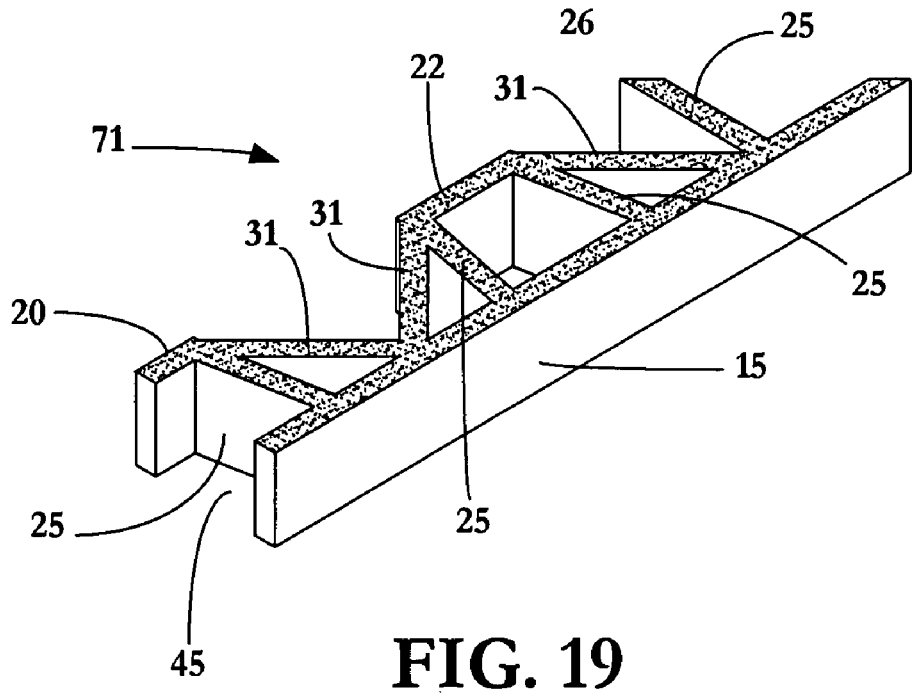
FIG. 19 is a perspective view of an alternate corner block unit derived by chamfering the double open-core block of FIG. 9.
Figure 20:
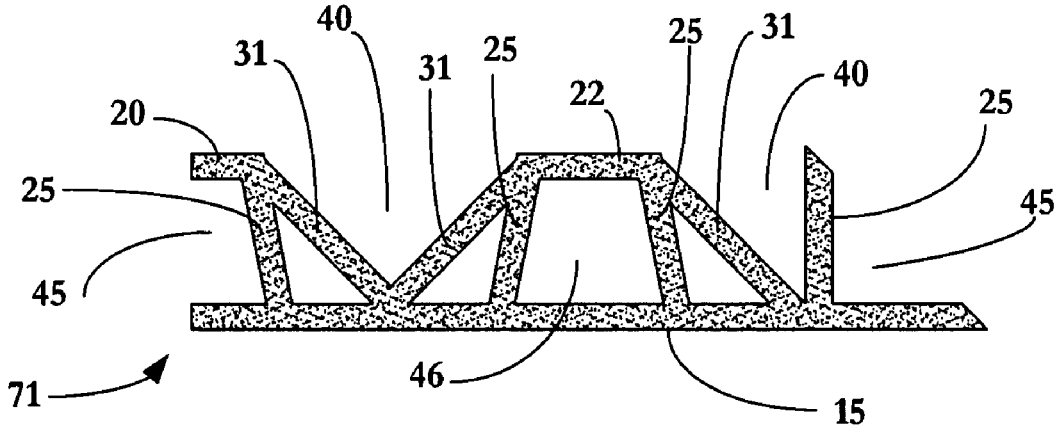
FIG. 20 is a top view of the alternate corner block unit of FIG. 19.
Figure 21:
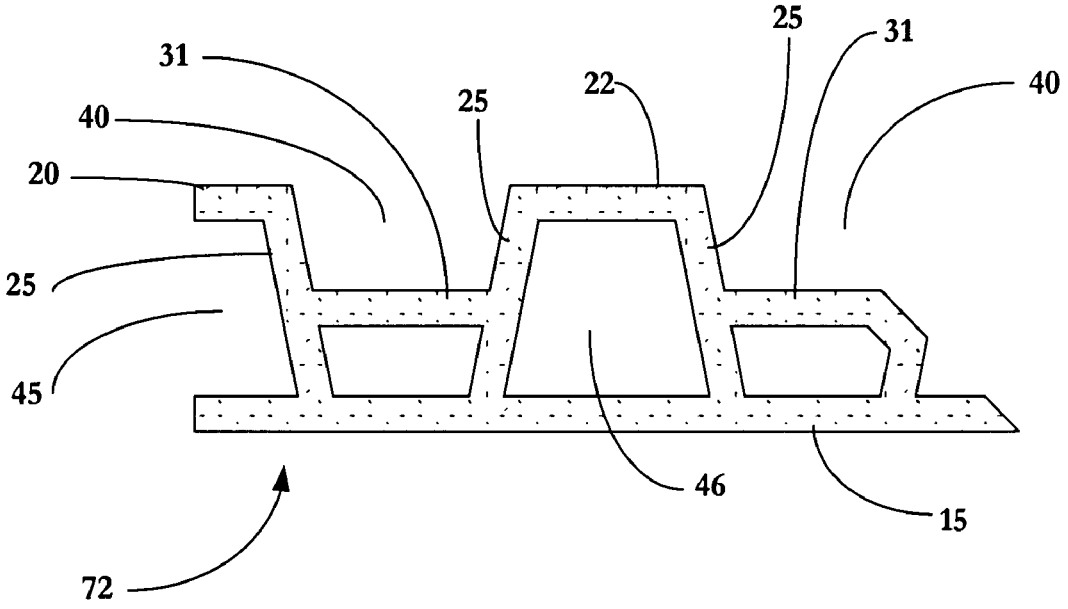
FIG. 21 is a top view of an alternate corner block unit derived by chamfering the double open-core block of FIG. 11.
Figure 22:
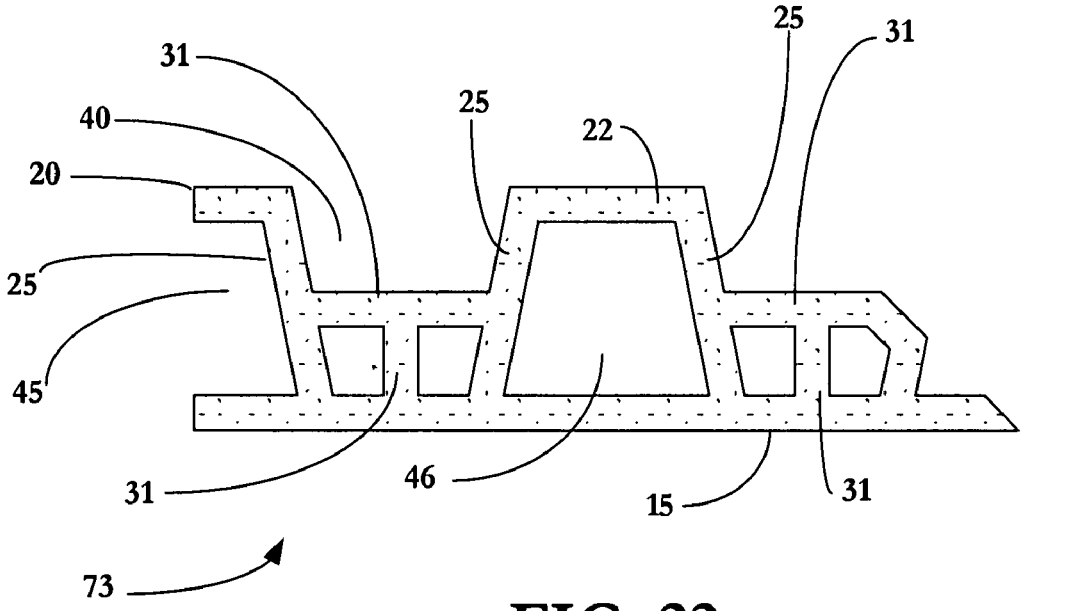
FIG. 22 is a top view of an alternate corner block unit derived by chamfering the double open-core block of FIG. 7.

Modifying double open-core block units will also produce effective corner units. FIGS. 17 and 18 depict a beveled-end double open-core block unit 70. The primary face 15 and one of the web struts 25 have been chamfered. The chamfered ends of two consecutive such blocks are angled complementary to one another so that when butted together, a corner assembly 130 with a defined longitudinal reinforcing chamber 131 is created as shown in FIG. 32. Besides beveling a typical double open-core block unit 50, the alternative embodiments of the double open-core block unit 50 may also be beveled to produce an effective corner unit. FIGS. 19, 20, 21 and 22 show beveled corner units 71, 72, and 73 derived from beveling the corresponding alternate embodiments of the double open-core block units 50. A sample assembly 135 is shown in FIG. 38.

Figure 40:
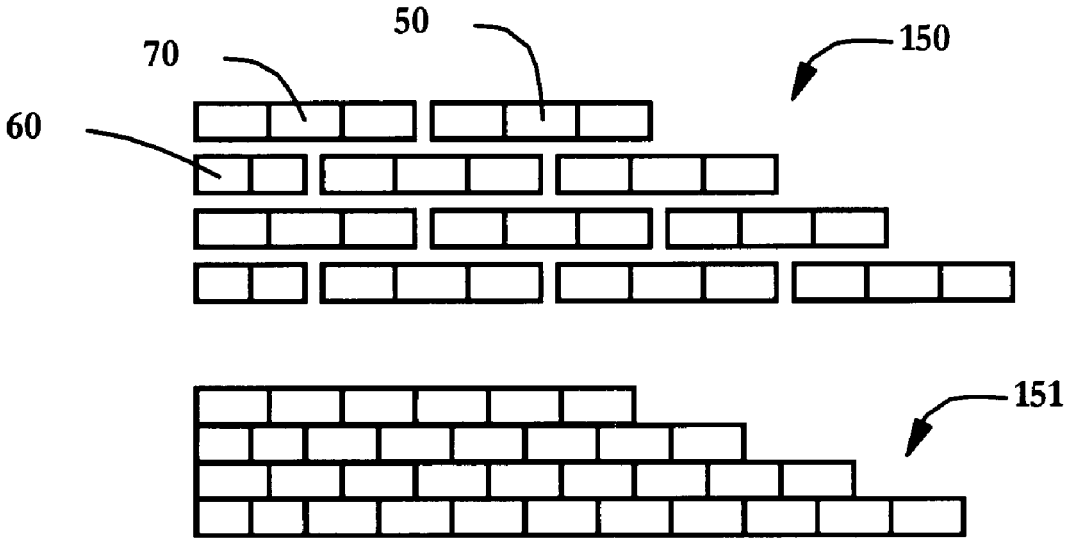
FIG. 40 shows front views of the blocks from FIGS. 3, 7, and 17, imprinted with a brick pattern, aligned and stacked for installation.
Figure 42:
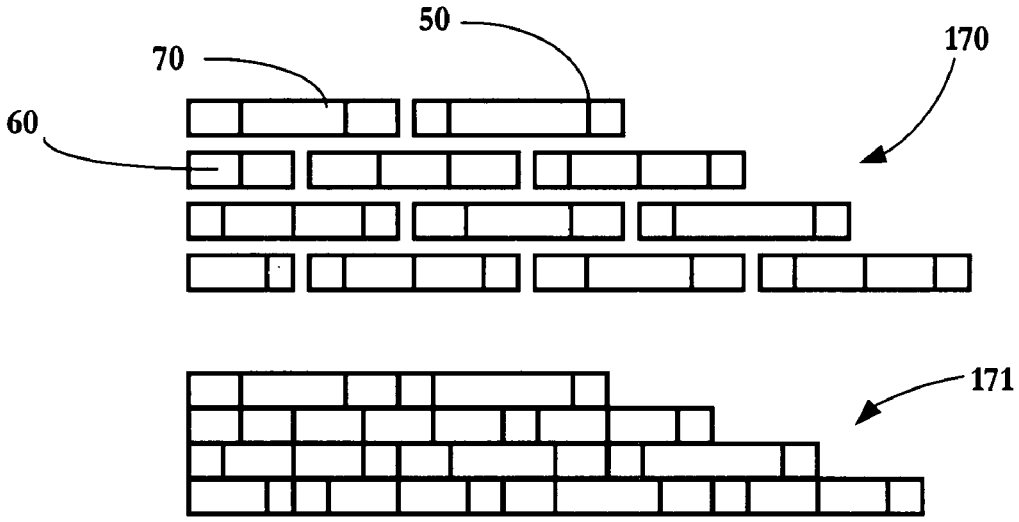
FIG. 42 shows front views of the blocks from FIGS. 3, 7, and 17, imprinted with a stone pattern, aligned and stacked for installation.

These alternative embodiments can be utilized to produce new brick and stone patterns for wall construction. FIG. 40 shows brick patterns 150 for the preferred corner units 60, double open-core block units 50, and beveled double open-core block units 70 used in place of corner block units 60. A running bond brick pattern 151 is created by alternating the preferred corner block units 60 with a corner formed from beveled double open-core block units 71, 72, or 73. FIG. 42 shows stone patterns 170 for the preferred corner units 60, double open-core block units 50, and beveled double block units 70 used in place of corner block units 60. A random stone pattern 171 is created by alternating the preferred corner block units 60 with a corner formed from beveled double open-core block units 71, 72, or 73. FIGS. 40 and 42 are representative of only a few of the many possible combinations of block substitutions and imprinting patterns.

Figure 23:
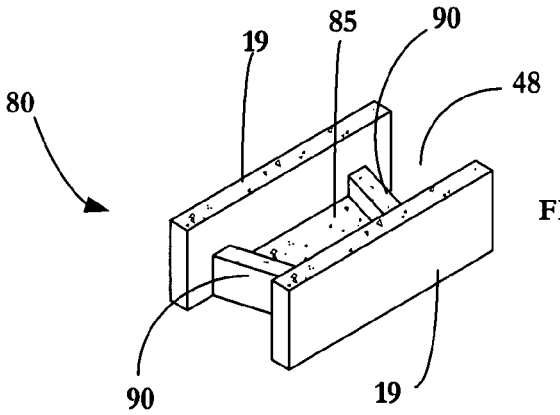
FIG. 23 is a perspective view of a bond beam block unit.
Figure 24:
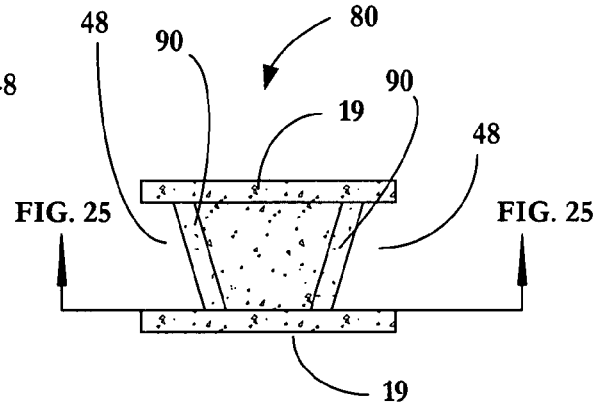
FIG. 24 is a top view of the bond beam block unit of FIG. 23.
Figure 25:
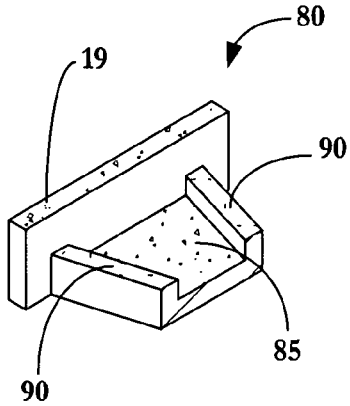
FIG. 25 is a perspective section view of the bond beam block unit of FIG. 23.

As is typical in block construction, horizontal reinforcing may be provided for the wall section by using special auxiliary units. Horizontal reinforcing is accommodated by the use of bond beam blocks 80 as shown in FIGS. 23, 24, and 25. The bond beam blocks 80 are placed directly over the single open-core block units 10 and double open-core block units 50 discussed above, aligning continuous flanges 19 of the bond beam with the primary face 15 and connecting flanges 20 of the blocks stacked below the bond beam block 80. A horizontal web 85 covers the cavity openings 40 of the blocks beneath while allowing passage of the vertical reinforcing through the exterior bond beam cores 48 for connection to the horizontal reinforcing resting on reinforcing support stands 90.

Figure 26:
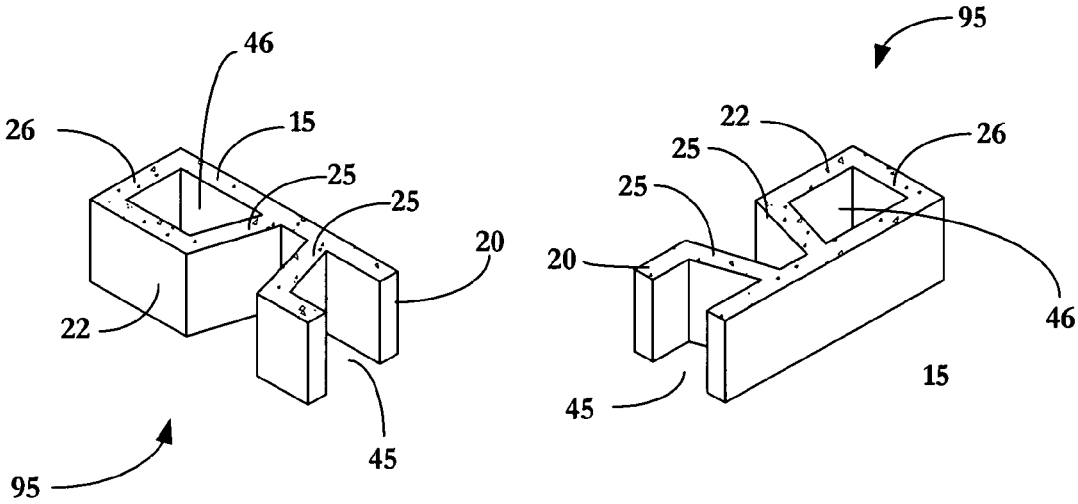
FIG. 26 shows perspective views of a jamb block.
Figure 27:
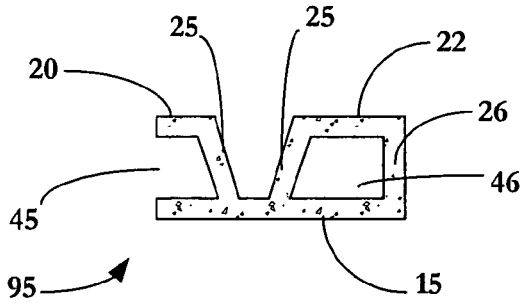
FIG. 27 is a top view of the jamb block of FIG. 26.
Figure 28:
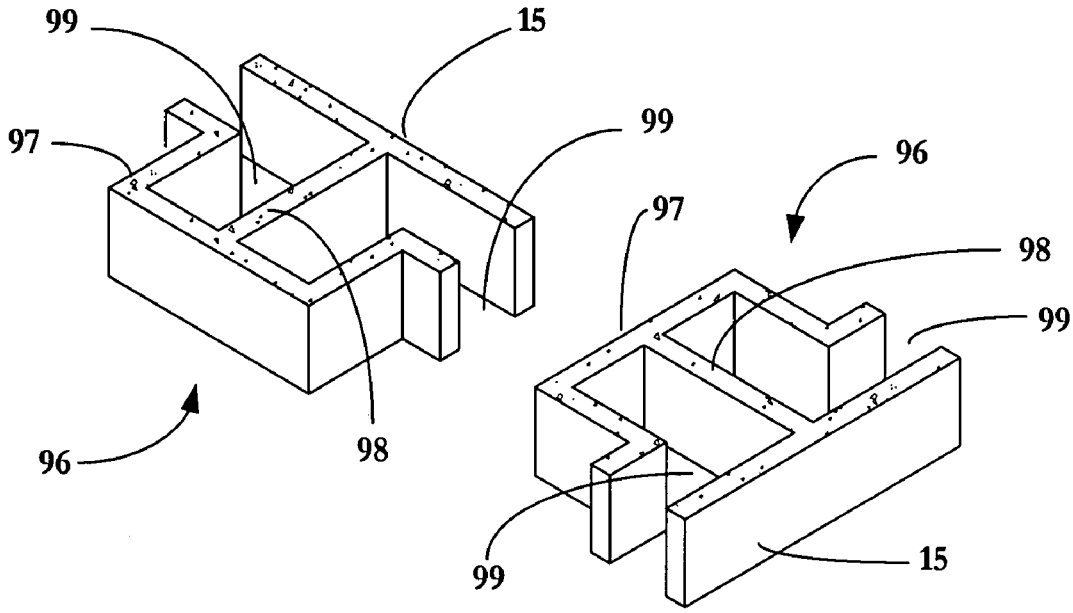
FIG. 28 shows perspective views of a pilaster/column block.
Figure 29:
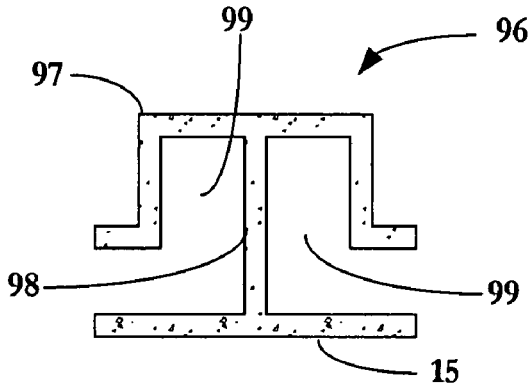
FIG. 29 is a top view of the pilaster/column block of FIG. 28.

Other special cases involving specific use blocks occur at wall openings such as doors and windows or at locations that require additional vertical reinforcing for pilasters or columns. For door and window openings, jamb blocks 95 as illustrated in FIGS. 26 and 27 are used. The jamb block 95 includes the closed core 46 that is formed by extending a jamb plate 26 between the connecting flange 22 and the primary face 15. The open core 45 of the jamb block 95 is butted against adjacent blocks to provide a connection to the rest of the wall section and the closed core 46 terminates the wall section at the opening to provide a continuous plane for window or door installation. For pilaster or column installation within the wall section, pilaster/column blocks 96 from FIGS. 28 and 29 are utilized. The bracket flange 97 and the primary face 15 of the pilaster/column blocks 96 are butted to the flanges of the adjacent blocks to form two L-shaped cores 99 separate by a web panel 98 for housing the vertical reinforcement system.

The specialty blocks, bond beam units 80, jamb blocks 95, and pilaster/column units 96, may be utilized as in typical block construction. Bond beam blocks 80 may be used to provide a housing for the horizontal reinforcement system. Jamb blocks 95 may be used to terminate a wall section at window and door openings. The closed-core 46 of the jamb block 80 provides a chamber for independent vertical reinforcement around the opening while the open-core 45 provides a positive mechanical connection to the rest of the wall section via the vertical reinforcement chamber defined between the jamb block 80 and the adjacent unit. At locations requiring pilasters or columns, pilaster/column blocks 96 may be used to incorporate these features as an integral part of the continuously connected wall system.

Besides structural walls, fences and screens may be formed using any of the methods or block combinations previously described. Roof and wall panels may be constructed using single and double blocks in association with property distributed beam blocks to provide the required transverse reinforcement and connection. Besides concrete, the blocks may be constructed of any material which exhibits sufficient compressive strength to match the capacity of the tensile reinforcement system employed, including various concrete mixtures, resins, wood, clay, plastic, and other composites.

It is clear that the present invention is well adapted to carry out its objectives and attain the ends and advantages mentioned above as well as those inherent therein. While presently preferred embodiments of the invention have been described in varying detail for purposes of disclosure, it will be understood that numerous changes may be made which will readily suggest themselves to those skilled in the art and which are encompassed within the spirit of the invention disclosed herein, in the associated drawings and the appended claims.

What is claimed is:

1. A structural block comprising:

a primary face;

a pair of flange assemblies, each flange assembly comprising:

a connecting flange; and a web strut attaching the connecting flange to the primary face;

a first reinforcing strut attached to each of the pair of flange assemblies, wherein the first reinforcing strut also attaches to the primary face; and wherein the web struts and first reinforcing strut form an unenclosed recess that is accessible from a direction generally perpendicular to the primary face.

2. A structural block comprising:

a primary face;

a pair of flange assemblies, each flange assembly comprising:

a connecting flange; and a web strut attaching the connecting flange to the primary face;

a first reinforcing strut attached to each of the pair of flange assemblies;

a second reinforcing strut; and wherein the web struts and first reinforcing strut form an unenclosed recess that is accessible from a direction generally perpendicular to the primary face; and wherein the first reinforcing strut is attached to both the primary face and at least one or the pair of web struts; and the second reinforcing strut is attached to both the primary face and at least one of the pair of web struts.

3. A structural block comprising:

a primary face;

a plurality of web struts;

a pair of connecting flanges, each of the connecting flanges attached to the primary face by one of the plurality of web struts;

a plurality of reinforcing struts, each of the plurality of reinforcing struts attached to a pair of web struts, wherein at least one of the plurality of reinforcing struts also attaches to the primary face;

an intermittent flange, attached to the primary face by at least two of the plurality of web struts; and wherein the plurality of web struts and the plurality of reinforcing struts form a plurality of unenclosed recesses that are accessible from a direction generally perpendicular to the primary face.

4. A structural block comprising:

a primary face;

a plurality of web struts;

a pair of connecting flanges, each of the connecting flanges attached to the primary face by one of the plurality of web struts;

a plurality of reinforcing struts, each of the plurality of reinforcing struts attached to a pair of web struts, wherein the each of the plurality of reinforcing struts is attached to at least one of the plurality of web struts and to the primary face;

an intermittent flange, attached to the primary face by at least two of the plurality of web struts; and wherein the plurality of web struts and the plurality of reinforcing struts form a plurality of unenclosed recesses that are accessible from a direction generally perpendicular to the primary face.

* * * * *